United States Patent [19]

McIntosh et al.

[11] Patent Number: 4,884,783

[45] Date of Patent: Dec. 5, 1989

[54] HOIST WITH OIL COOLED BRAKE

[75] Inventors: R. Bruce McIntosh, Rolling Stone; Royal G. Thern, Winona, both of Minn.

[73] Assignee: Thern, Inc., Winona, Minn.

[21] Appl. No.: 155,285

[22] Filed: Feb. 12, 1988

[51] Int. Cl.[4] ..... B66D 1/14; B66D 5/10

[52] U.S. Cl. ..... 254/343; 254/356; 254/378; 254/DIG. 14

[58] Field of Search ..... 254/220, 222, 229, 296, 254/310, 322, 343, 356, 378, DIG. 14; 242/117; 188/264 E

[56] References Cited

U.S. PATENT DOCUMENTS

| | | | |
|---|---|---|---|
| 1,193,366 | 8/1916 | Demara | 188/264 E |
| 1,739,353 | 12/1929 | Criteser | 254/343 |
| 1,756,459 | 4/1930 | Gormley | 254/343 |
| 1,913,508 | 6/1933 | Phillips | 242/117 |
| 2,083,954 | 6/1937 | Kessler | 254/343 |
| 2,133,910 | 10/1938 | Vollmer | 254/343 X |
| 2,393,120 | 1/1946 | Perman | 254/343 |
| 2,683,584 | 7/1954 | Selberg | 242/117 X |
| 2,710,738 | 6/1955 | Wittberger | 254/186 |
| 2,746,583 | 5/1956 | Blevins | 192/2 |
| 3,467,359 | 9/1969 | Durand | 254/343 X |
| 3,658,299 | 4/1972 | Sprague | 254/343 |
| 3,667,312 | 6/1972 | Dahl | 254/343 X |
| 3,784,165 | 1/1974 | Pruitt | 254/362 X |
| 3,819,156 | 6/1974 | Sieracki | 254/173 R |
| 3,825,100 | 7/1974 | Freeman | 188/71.2 |
| 3,883,119 | 5/1975 | Hansson | 254/254 |
| 4,046,235 | 9/1977 | Shutt | 188/134 |
| 4,057,219 | 11/1977 | Sobolewski | 254/283 |
| 4,103,872 | 8/1978 | Hirasuka | 254/168 |
| 4,128,228 | 12/1978 | Ziegelmann | 254/362 X |
| 4,236,618 | 12/1980 | West | 192/8 R |
| 4,434,973 | 3/1984 | Desplats | 254/344 |
| 4,493,479 | 1/1985 | Clark | 254/274 |
| 4,530,474 | 7/1985 | Nederman | 242/84.52 R |
| 4,635,491 | 1/1987 | Yamano et al. | 74/89.15 |

FOREIGN PATENT DOCUMENTS

| | | | |
|---|---|---|---|
| 42801 | 12/1981 | European Pat. Off. | 254/342 |

*Primary Examiner*—Joseph J. Hail, III

*Attorney, Agent, or Firm*—Hugh D. Jaeger

[57] ABSTRACT

A compact, lightweight, electrically powered hoist with a drum used for hoisting or lowering a payload. A vertically oriented reversible motor is controlled by a control pendant with a momentary switch to drive a helical gear reduction and a worm gear reduction. A worm shaft and a drum shaft wind wire rope on a drum. A one-way clutch and a brake on a driven shaft free-wheel during hoisting operations. A clutch and brake hold the payload in a hoisted position. Lowering of the hoisted payload is accomplished by reversal of the motor, and driving a shaft and clutch against the torque of the engaged brake. A wire rope with a swaged fitting is anchored to the drum by engagement in a keyhole. The hoist may be mounted horizontally, vertically or on a ceiling.

1 Claim, 6 Drawing Sheets

HOIST WITH OIL COOLED BRAKE

BACKGROUND OF THE INVENTION

1. Field of the Invention—The present invention pertains to a reversible electric hoist, and more particularly, pertains to a hoist with a one-way clutch and brake secured over a worm shaft. The brake and clutch are not effectively engaged during hoisting motions, but hold a hoisted payload in a static position. A payload is lowered by reversed action of a drive motor against the clutch and brake.

2. Description of the Prior Art—There are a number of base mounted drum hoists, each employing a variety of prime movers, geared systems and one-way clutches engaging a disc brake.

The present invention provides a hoist which employs a one-way clutch and an adjustable band brake operated in an oil bath to hold a hoisted payload, which is lowered by motor action against the clutch and band brake.

SUMMARY OF THE INVENTION

The present invention includes a reversible motor to rotate a drum to either hoist, hold or lower a payload. A one-way clutch and drum on a driven worm shaft are inactive during hoisting motions, and requires motor activation against the one-way clutch and drum to lower a payload.

According to one embodiment of the present invention, there is provided a reversible motor which mounts on an aluminum motor adapter, which in turn mounts on a lightweight aluminum frame and speed reducer housing. A helical pinion on the motor drive shaft drives a helical gear on a worm shaft located in the reducer housing. The worm shaft aligns in an upper bearing in the aluminum motor adapter and a lower bearing in the bottom of the speed reducer housing. A worm drive on the worm shaft drives a worm gear which in turn imparts rotary motion to a drum shaft and drum for the purpose of hoisting or lowering a payload. A one-way clutch affixes to the worm shaft and a brake drum frictionally engages over the worm shaft. An adjustable brake assembly, including a brake band with a brake lining, positions over and about the brake drum and one-way clutch. In a hoisting operation the clutch spins freely and free-wheels with reference to the brake assembly in the hoisting direction until a static hoisted position is attained, at which point the clutch is automatically engaged. The brake holds a payload in the hoisted position. The brake and clutch also prevent reverse drum motion during hoisting. In a lowering operation, lowering of a hoisted payload is accomplished by reversing the motor direction to overcome the friction of the clutch and brake drum against the brake band and brake lining to allow reverse motion of the worm shaft, worm drive and gear, and the drum shaft and drum.

One significant aspect and feature of the present invention, is a one-way clutch and brake system which does not inhibit payload hoisting Another significant aspect and feature of the present invention is the use of a one-way clutch and brake system whose friction must be overcome to lower a payload.

Still another significant aspect and feature of the present is a lightweight hoist system with a slim foot print which can be mounted in compact spaces and in various orientations.

Yet another significant aspect and feature of the present invention is a hoist utilizing a lightweight casting, which serves as a hoist frame and enclosure for the drive components which is less expensive to manufacture, easier to seal and lighter in weight than separable frames and enclosures.

A further significant aspect and feature of the present invention is a simplified motor reversal system eliminating the need for magnetic contactors while preserving the inherent safety of a momentary contact "dead-man" switch Still a further significant aspect and feature of the present invention is a keyhole wire rope anchor and associated ramp for the simplified anchoring of a wire rope to the hoist drum.

Yet another significant aspect and feature of the present invention is a light weight brake which requires no electrical switches or components to engage and disengage.

Still another significant aspect and feature of the present invention is an oil bath enhancing smooth motion, long brake lining life and removal of heat from the brake lining.

Having thus described the embodiments of the present invention, it is a principal object hereof to provide a reversible, lightweight, electric hoist and control system with a one-way clutch and a brake mechanism.

Another object of the present invention is to provide an improved method of attachment of a wire rope to a hoist drum.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
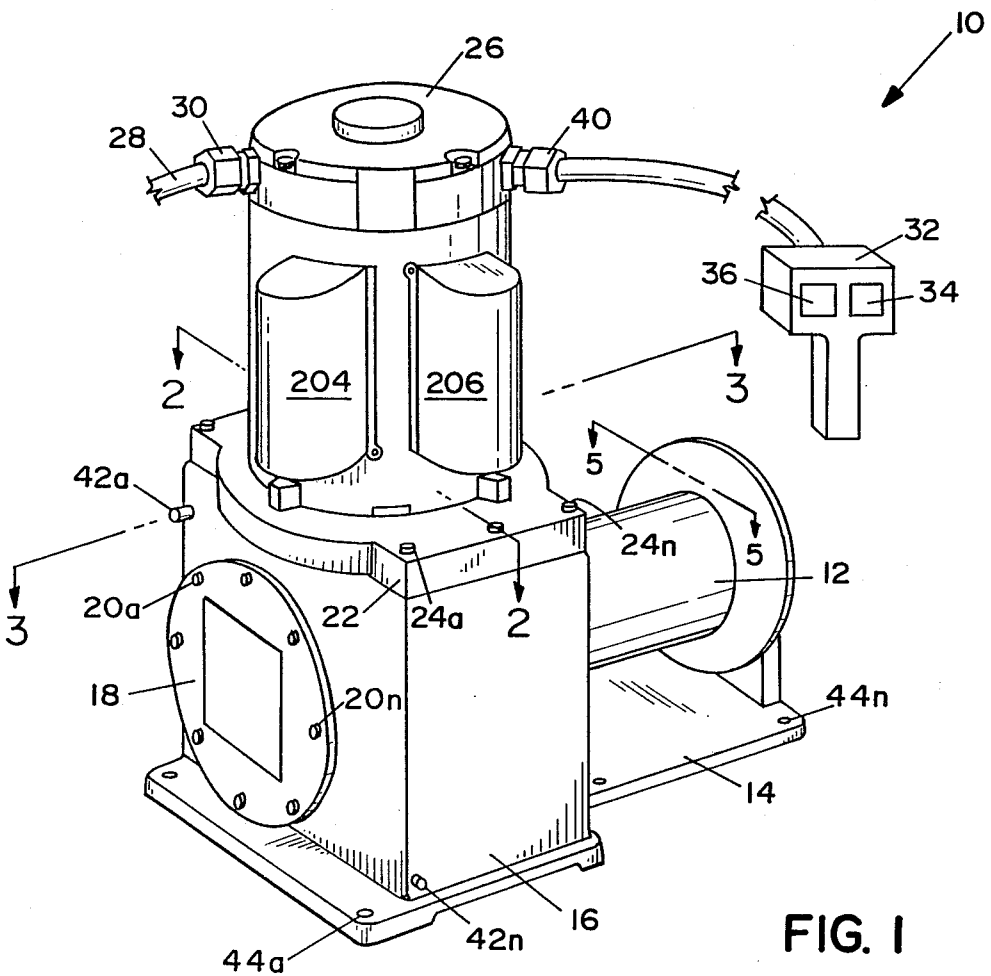
FIG. 1 illustrates a perspective view of a hoist.

FIG. 1 illustrates a perspective view of a hoist 10, the present invention. The exterior components of the hoist 10 include a hoist drum 12; a configured frame 14; a sealed box like speed reducer housing 16 which is cast with and is an integral part of the frame 14; a bearing holder 18 secured to the sealed speed reducer housing 16 by a plurality of machine screws 20*a*–20*n;* an aluminum motor adapter 22 secured to the sealed speed reducer housing 16 by a plurality of screw fasteners 24*a*–24*n;* and vertically aligned reversible motor 26 secured to the motor adapter 22. The configured frame 14 and sealed speed reducer housing 16 are a common aluminum casting for weight reduction. Internal rotating components are lubricated by and operate in an oil bath in the sealed speed reducer housing 16. A power cord 28 and connector 30 secure to the reversible motor 26. A control pendant 32 including a power switch 34 and a rocker switch 36 for direction control attaches to the reversible motor 26 by a cable 38 and a connector 40. A plurality of drain/level plugs 42*a*–42*n* position at strategic points about the sealed speed reducer housing 16 to accommodate vertical alignment of the hoist 10 as illustrated, as well as other positional alignments such as a ceiling mount. A plurality of mounting holes 44*a*–44*n* position on the configured frame 14 for securement of the hoist 10 to an external mounting base.

Figure 2:
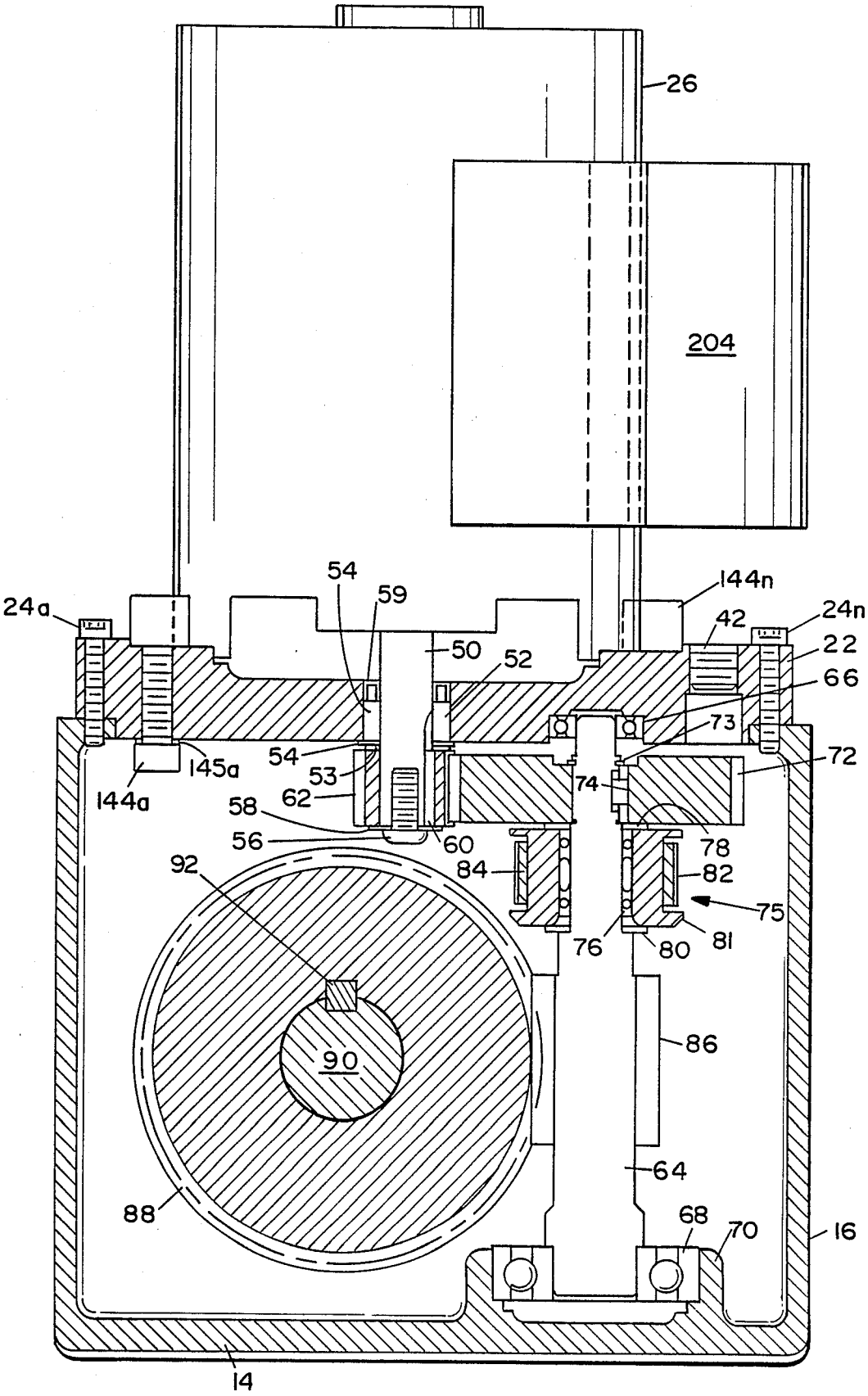
FIG. 2 illustrates a cross-sectional view taken along line 2—2 of FIG. 1 of the hoist components in the speed reducer housing.

FIG. 2 illustrates a cross-sectional view taken along line 2—2 of FIG. 1 of the hoist 10 with components contained in the sealed speed reducer housing 16. All numerals correspond to those elements previously described. A vertically aligned keyed motor shaft 50 aligns in a hole 52 in the motor adapter 22, in a shim 53, in a porous oil impregnated motor pinion thrust washer 54, and within a seal 59 in the hole 52. A cap screw 56, a washer 58, and a key 60 engage in the keyed motor shaft 50 and secure a helical pinion 62 to the keyed motor shaft 50. A vertically oriented multi-radiused worm shaft 64 secures between an upper bearing 66 in the motor adapter 22 and a lower bearing 68 in a bearing housing 70 on the inner lower surface of the sealed speed reducer housing 16 whose bottom is integral to the horizontal configured frame 14. A helical gear 72 secures over and to the multi-radiused worm shaft 64 with a retainer ring 73 and by a key 74. A brake assembly 75 includes a one-way clutch 76, a brake drum 81, a brake band 82, and a brake lining 84 and other components as described later in detail. The one-way clutch 76, with spacers 78 and 80 align over each clutch end, and frictionally engages and secures over and to the multi-radiused worm shaft 64. The brake drum 81 frictionally engages over and to the one-way clutch 76. A brake band 82, including a brake lining 84, positions over and about the brake drum 81. The one-way clutch 76 is further described in detail in FIG. 4. A worm drive 86 on the multi-radiused worm shaft 64 drives a worm gear 88 secured to a horizontally aligned drum shaft 90 by a key 92. Ultimately, the drum shaft 90 and drum 12 are driven by action of the reversible motor 26 upon and through the helical pinion 62, the helical gear 72, the multi-radiused worm shaft 64, worm drive 86, and the worm gear 88.

During hoisting operations, the multi-radiused worm shaft 64 is driven as previously described and freewheels and turns freely within the one-way clutch 76 and the brake band 82 and the brake lining 84 have no effect on the mechanical drive components. In the static hoisted position, the clutch is automatically engaged as it is against reverse motion during hoisting. The brake drum 81, over the engaged clutch 76, is held by action of the brake band 82 and lining 84. The clutch also prevents any lowering motion should power to the motor be interrupted. During lowering, the multi-radiused worm shaft 64 is driven by reverse motor action against the brake assembly 75, and must overcome the brake torque caused by the brake action of the brake band 82 and brake lining 84 against the brake drum 81 and engaged one-way clutch 76 to cause the hoisted payload to be lowered.

During hoisting, the reversible motor 26 must do work against the payload in order to increase its potential energy. When the payload is stationary, the brake assembly 75 supplies torque to counter the payload's gravitational pull. In order to lower the payload, the reversible motor 26 must work against the brake assembly 75, the energy converted to heat, in order to cause the drive train rotation that lowers the payload and reduces the potential energy.

The one-way clutch 76 allows the brake assembly 75 to always be in the system, and yet the brake friction does not inhibit the motor's ability to hoist a payload.

Figure 3:
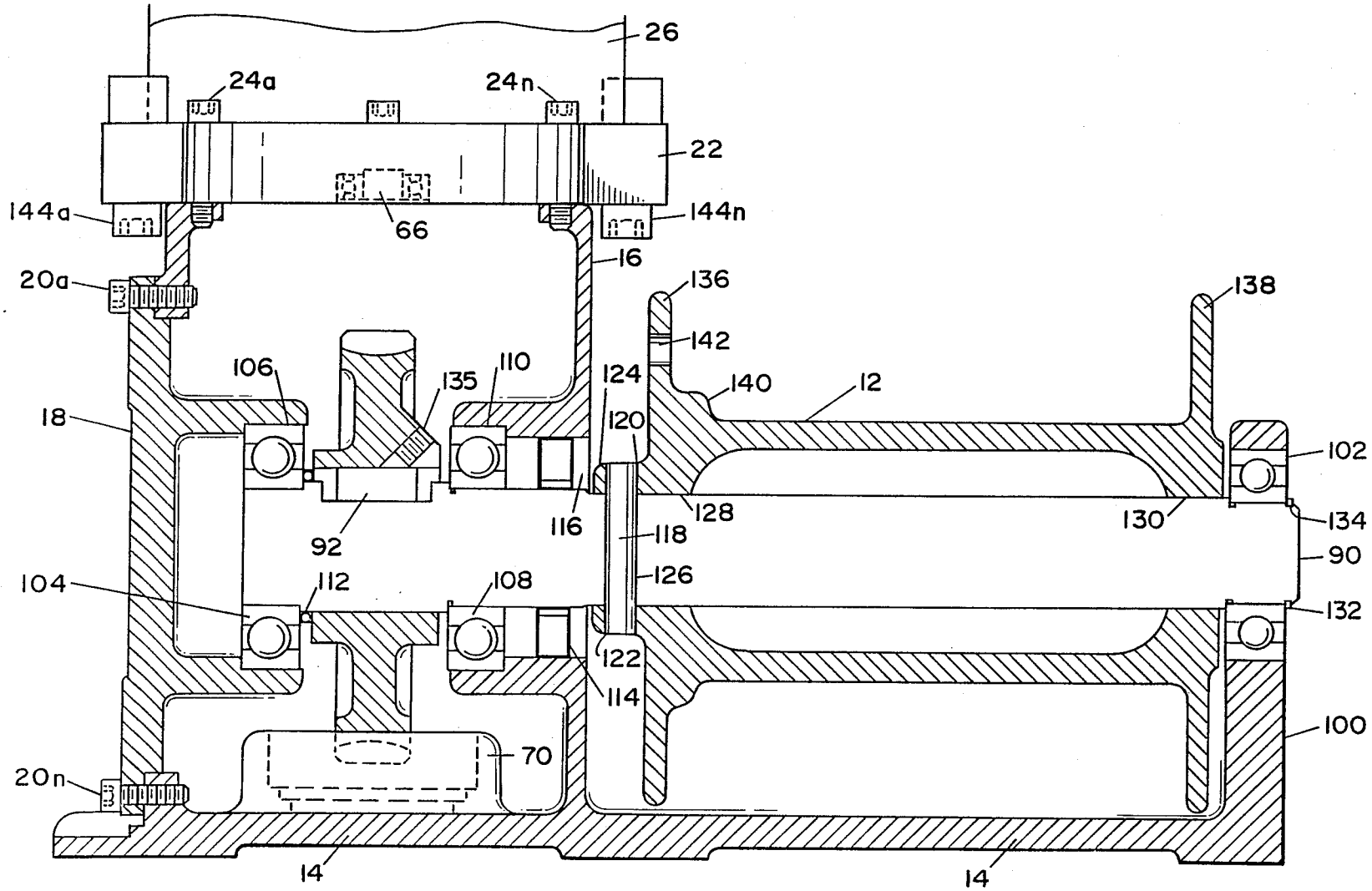
FIG. 3 illustrates a cross-sectional view taken along line 3—3 of FIG. 1 of the hoist support, drum and bearing members.

FIG. 3 illustrates a cross-sectional view taken along line 3—3 of FIG. 1 of the hoist 10, the support, the drum and the bearing members where all numerals correspond to those elements previously described. The configured frame 14 and sealed box like speed reducer housing 16 are a common lightweight aluminum casting. A vertical bearing support member 100 extends upwardly from the configured frame 14 to house a horizontally aligned outboard bearing 102. The outboard bearing 102 prevents cantilever loading of the drum shaft 90. A horizontally aligned bearing 104 mounts in a cavity 106 in the bearing holder 18, and a similar bearing 108 is mounted in a cavity 110 in a side wall of the sealed speed reducer housing 16 to accommodate the opposite end of the drum shaft 90. A spacer 112 is positioned between bearing 104 and the worm gear 88, and a drum shaft seal 114 positions over the drum shaft 90 and in a seal cavity 116. A connecting pin 118 secures through holes 120 and 122 in the drum collar 124 and through hole 126 in the drum shaft 90 to positionally secure the hoist drum 12 to the drum shaft 90. Bores 128 and 130 in the sidewalls of the hoist drum 12 align over and about the drum shaft 90. A retaining ring 132 secures in an annular groove 134 in the drum shaft 90 to secure the drum shaft 90 to the outboard bearing 102. The worm gear 88 is secured to the drum shaft 90 by a key 92 and by a set screw 135. The hoist drum 12 also includes side walls 136 and 138 and an integral ramped surface 140 on the inner end of the hoist drum 12 to serve as a guide to orient a wire rope correctly on the drum. A wire rope key hole 142 in the side wall 136 of the hoist drum 12 accommodates a wire rope with a swaged fitting as later explained in detail. The ramped surface 140 adjacent to the wire rope key hole 142 directs wire rope in the correct direction and fills the void behind the first wrap of wire rope. The reversible motor 26 is secured to the motor adapter 26 by a plurality of machine screws 144*a*–144*n*. A plurality of O ring seals 145*a*–145*n* secure beneath machine screws 144*a*–144*n* to provide for housing 16 sailing.

Figure 4:
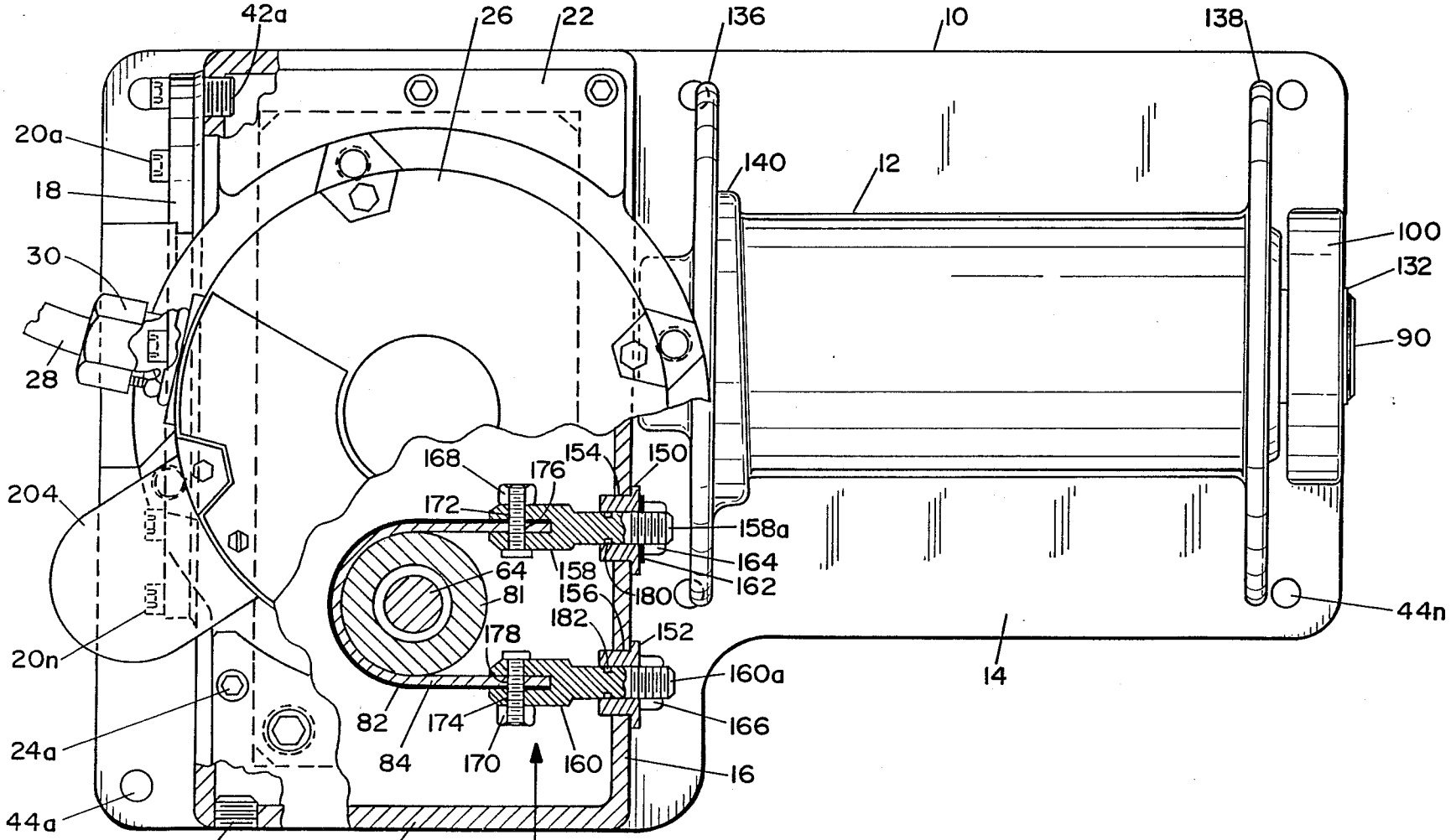
FIG. 4 illustrates a cutaway top view of a brake assembly.

FIG. 4 illustrates a cutaway top view of the hoist 10 illustrating elements of the brake assembly 75 as previously described and additional elements as now described herein where all numerals correspond to those elements previously described. Bushings 150 and 152 mount in holes 154 and 156 in the sealed speed reducer housing 16 to accommodate threaded brake band connectors 158 and 160. A brake tension spring 162 and a brake tension nut 164 fit over the threaded shaft portion 158*a* of the brake band connector 158, and a brake tension nut 166 fits over the threaded portion 160*a* of the brake band connector 160. Nut and bolt assemblies 168 and 170 align in holes 172 and 174 of the brake band connectors 158 and 160 and also in holes 176 and 178, common to the brake band 82 and brake lining 84, to secure the brake band 82 and brake lining 84 to the brake band connectors 158 and 160, respectively. Brake band tension about the brake drum 81 is adjusted to the proper tension increment by adjusting brake tension nuts 164 and 166. Elastomeric O-ring fittings 180 and 182 position in grooves on the brake band connectors 158 and 160 and against the interior surfaces of bushings 150 and 152 to further provide oil sealing for the speed reducer housing 16.

Figure 5:
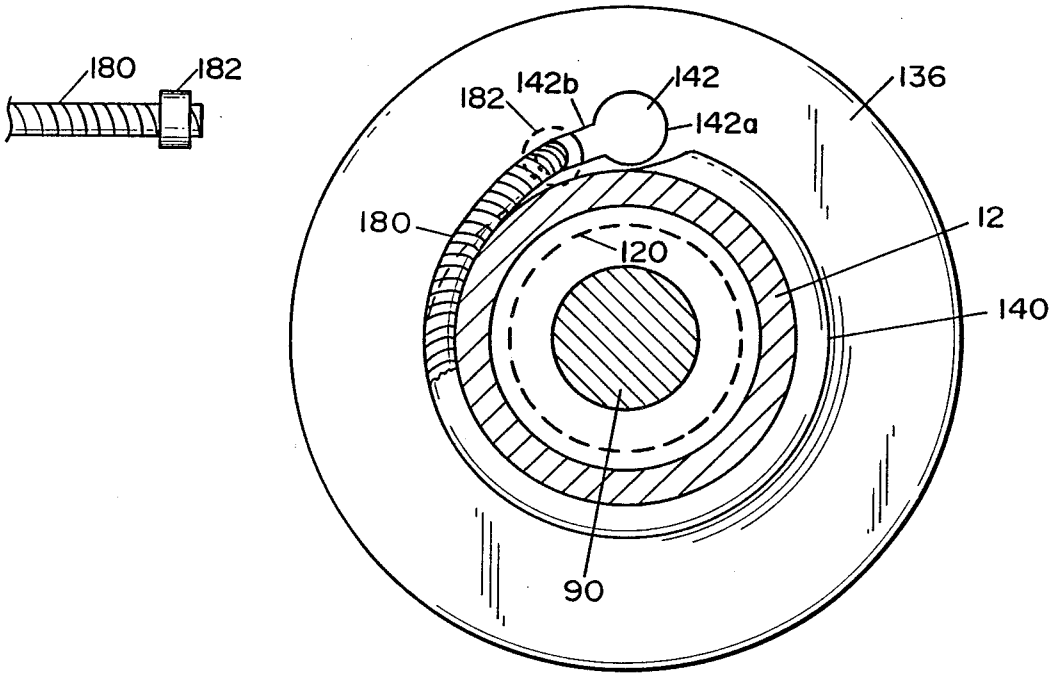
FIG. 5 illustrates a cross-sectional view of the drum taken along line 5—5 of FIG. 1; and, FIG. 6 illustrates an electrical diagram of the motor control system.

FIG. 5 illustrates a cross-sectional view of the drum looking toward the sealed speed reducer housing 16 taken along line 5—5 of FIG. 1, illustrating the method of wire rope attachment to the hoist drum 12 and where all numerals correspond to those elements previously described. A wire rope key hole 142 in the sidewall member 136 of the hoist drum 12 includes a hole **142*a* and a down sized slotted hole 142*b*. A wire rope 180 with a swaged fitting 182 affixed to its end, also illustrated adjacent to the drum 12, passes first within the larger hole 142*a* and then positions into the slotted hole 142*b* where it is frictionally engaged by the swaged fitting 182 within the smaller dimensioned slotted hole 142. The hoist drum 12 is rotated to wrap the wire rope 180 about the cylindrical surface of the drum 12 and is assisted by the ramped surface 140**.

Figure 6:
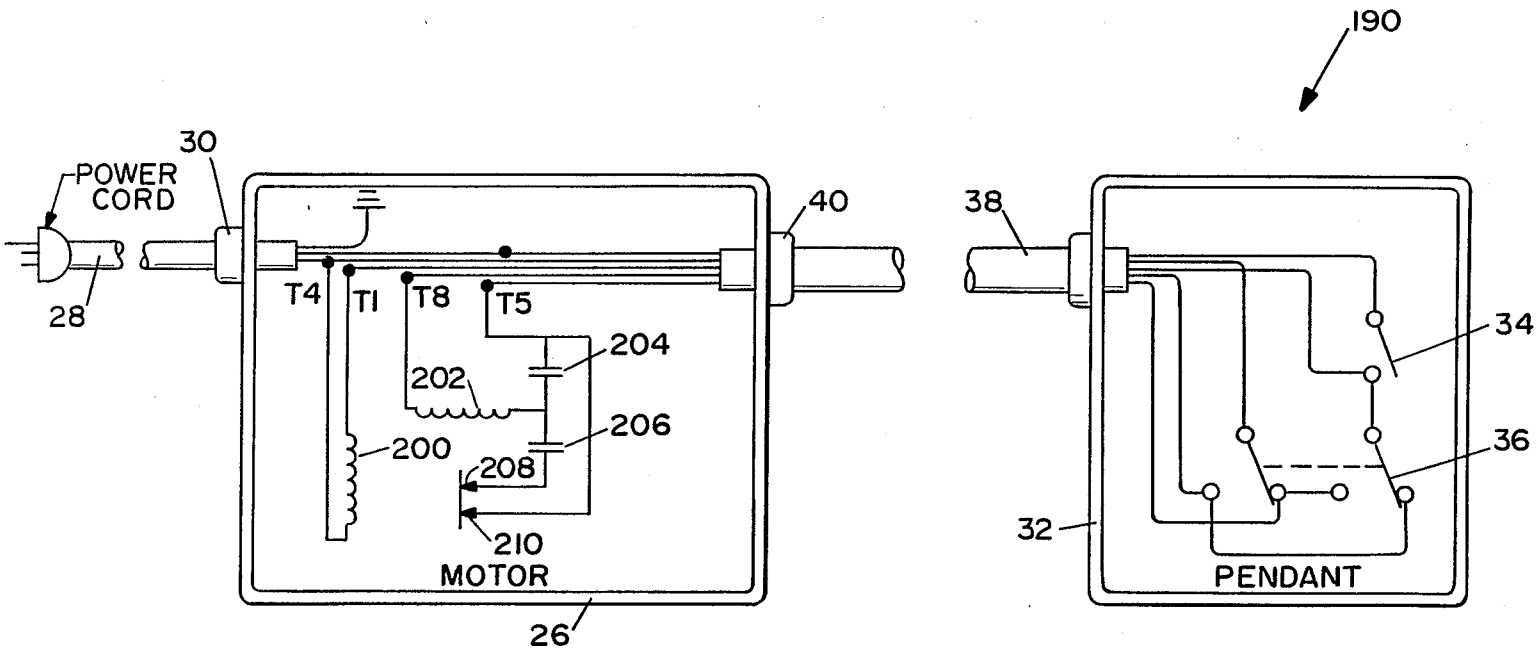

FIG. 6 illustrates an electrical diagram 190 of the motor control system for the hoist 10 where all numerals correspond to those elements previously described. Power is delivered to the reversible motor 26 by power cord 28 and to the control pendant 32 by cable 38. A first momentary contact power switch 34 delivers electrical power to a second rocker switch 36. The second switch 36 is used to select clockwise or counter clockwise rotation of the reversible motor 26 for hoisting a payload or lowering a payload against the torque of the brake assembly 75. The momentary contact power switch 34 is depressed for hoisting or lowering. Power is applied to the rocker switch 36, which has been preselected for hoisting or lowering, by activating the momentary power switch 34. Switch 34 also acts as a "dead-man" safety switch in that if the hoist operator's finger is removed from the switch, all power is interrupted to the motor, and the payload is held in position by the one-way clutch and brake. The rocker switch 36 provides electrical current to motor coils 200 and 202, motor capacitors 204 and 206, and motor contactors 208 and 210 in conjunction with activation of switch 34 to provide for motor directional control to hoist or lower a payload.

MODE OF OPERATION

The hoist 10 is mounted vertically or horizontally on an appropriate mounting surface such as including mounting on a ceiling or any other predetermined location. The reversible motor 26 is activated by a hoist operator by first selecting the direction the drum is to rotate by depressing switch 36 on the control pendant 32 and then depressing the momentary power switch 34, also called a dead-man safety switch, to deliver electrical power to the reversible motor 26. Helical pinion 62 is rotated by the motor shaft 50 to turn the helical gear 72 and the worm shaft 64.

In a hoisting operation the worm drive 86 on the worm shaft 64 turns the worm gear 88, the drum shaft 90 and the drum 12. The one-way clutch 76 free-wheels within the brake drum 81, and the brake drum 81 is held stationary by the brake band 82 and brake lining 84. The clutch 76 is always ready to be automatically engaged against motion reversal when the worm shaft 64 motion ceases, either during a mid-hoisting operation to hold the payload in a static position should electrical power be interrupted by electrical failure or operator diversion, a safety function, or when the operator normally releases switch 34 when the payload reaches its desired level. Friction between the worm gear 88 and the worm drive 86 also assists in holding of a hoisted payload.

Lowering of the payload is accomplished by activating switch 36 and subsequently switch 34 to reverse the motor direction, and thus, the rotational direction of the drum 12. At this time, the free-wheeling motion of the one-way clutch 76 ceases and the shaft 64 is frictionally engaged to the brake drum 81 through the one-way clutch 76. The worm shaft 64, the one-way clutch 76 and the brake drum 81 turn as a unit to overcome the friction caused by the brake band 82 and brake lining 84 against the brake drum 81, allowing the worm drive 86 to drive the worm gear 88, drum shaft 90 and drum 12 to lower a payload.

The clutch and brake system provide for braking which is more positive than brake systems which rely upon worm gear friction exclusively. The swaged fitting 182 on the wire rope 180 is frictionally engaged in the wire rope key hole 142 as opposed to pinching and weakening the wire rope 180 under a clamp arrangement. The ramped surface 140 adjacent to the wire rope key hole 142 assist in orienting of the wire rope 180 around and about the drum 12.

Various modifications can be made to the present invention without departing from the apparent scope thereof.

We claim:

1. A hoist for the hoisting or lowering of a payload, comprising:

a. a lightweight one-piece frame including a sealed speed reducer housing and bearing support member;

b. a reversible vertically oriented motor operated by electrical power for driving a helical pinion, a helical gear, a worm shaft, worm drive, a worm gear and a drum shaft and drum;

c. a one-way clutch and brake drum secured over and about said worm shaft, said clutch free-wheels within said drum during hoisting operations, said clutch engages during a hoisting operation when electrical power is interrupted, said clutch assists in holding hoisted payload until acted upon by reversing of said reversible motor, said worm drive and worm gear is used to hold a hoisted load, and said motor reverse drives said worm shaft and said engaged one-way clutch and said brake drum against the friction of a brake band with a brake lining to reverse said worm gear and said drum to lower a load;

d. a brake band and brake lining positioned over and about said brake drum and one-way clutch;

e. said worm drive engaged with said worm gear to assist in holding a static hoisted payload;

f. a wire rope with a swaged fitting frictionally engaged in a wire rope keyhole to fasten said wire rope to said drum;

g. a drum with a ramp to assist said wire rope winding about said drum;

h. a fluid-tight housing containing said brake drum, said brake band, and said brake lining wherein said housing is filled with oil whereby said brake drum, said brake band, and said brake lining are cooled; and, i. electrical means connected to said motor means and including a first switch to deliver to a second directional switch to control hoisting or lowering of payload and said first switch is a dead-man safety switch.

* * * * *